US005605195A

United States Patent [19]

Eslinger et al.

[11] Patent Number: 5,605,195

[45] Date of Patent: Feb. 25, 1997

[54] INFLATION SHAPE CONTROL SYSTEM FOR INFLATABLE PACKERS

[75] Inventors: David M. Eslinger, Tulsa, Okla.; L. Michael McKee, Alvin, Tex.; Robert M. Sorem, Lawrence, Kans.; Kevin L. Case, Richmond; Jean L. Pessin, Houston, both of Tex.

[73] Assignee: Dowell, a division of Schlumber Technology Corporation, Houston, Tex.

[21] Appl. No.: 585,215

[22] Filed: Jan. 11, 1996

Related U.S. Application Data

[62] Division of Ser. No. 362,629, Dec. 22, 1994.

[51] Int. Cl.[6] ..... E21B 33/127

[52] U.S. Cl. ..... 166/387; 166/187

[58] Field of Search ..... 166/187, 387

[56] References Cited

U.S. PATENT DOCUMENTS

| | | | |
|---|---|---|---|
| 2,828,823 | 4/1958 | Mounce | 166/187 |
| 3,134,441 | 5/1964 | Barry et al. | 166/187 |
| 3,524,503 | 8/1970 | Baker | 166/187 X |
| 3,941,190 | 3/1976 | Conover | 166/187 |
| 4,951,747 | 8/1990 | Coronado | 166/187 |
| 5,417,289 | 5/1995 | Carisella | 166/387 |
| 5,469,919 | 11/1995 | Carisella | 166/387 |

*Primary Examiner*—Hoang C. Dang
*Attorney, Agent, or Firm*—John E. Vick, Jr.

[57] ABSTRACT

An inflatable packer used in a well and having a mandrel carrying upper and lower heads, a normally retracted inflatable packer element including an inner elastomer bladder and an outer expansible armor or carcass, the ends of the packer element being anchored to respective heads, and in one embodiment a hydraulically operable system that applies restraining force to the heads which controls the shape and deployment of the packer element during inflation and prevents entrapment of fluid bubbles outside the element and the formation of Z-folds in the bladder. In other embodiments the restraining force is supplied by a stack of disc springs, by frictional engagement between parts, by a shearing action of materials, by swaging a sleeve member, and by axially crushing a sleeve member.

10 Claims, 5 Drawing Sheets

FIG. 7
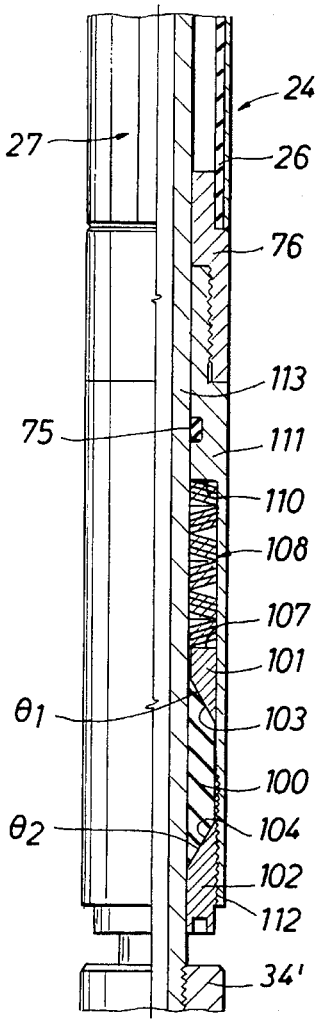
FIG. 10
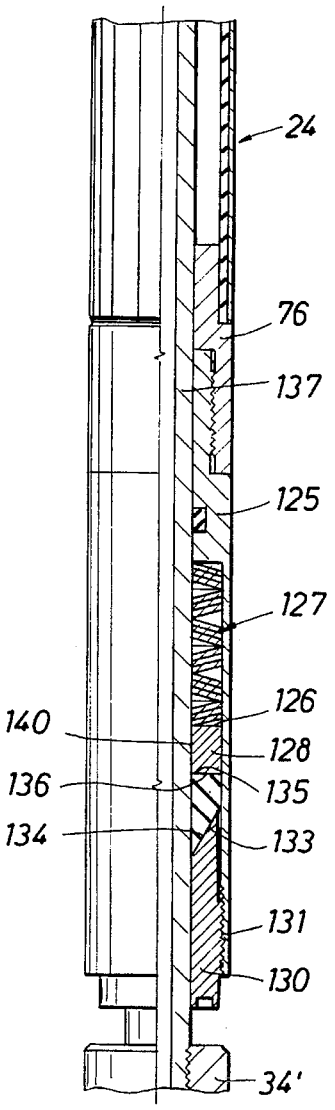
FIG. 9
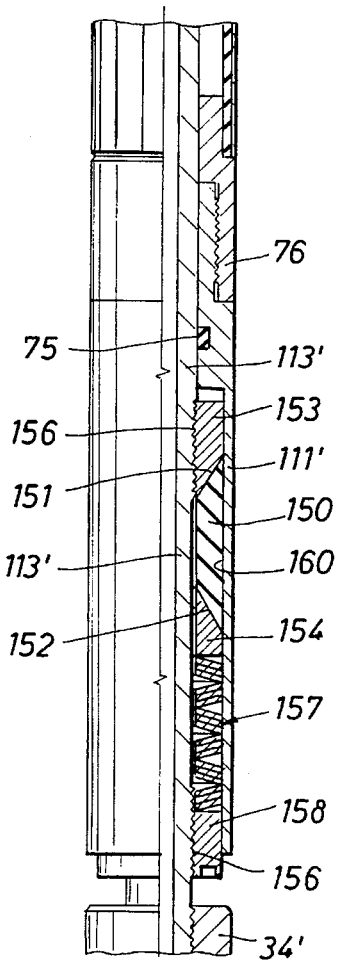
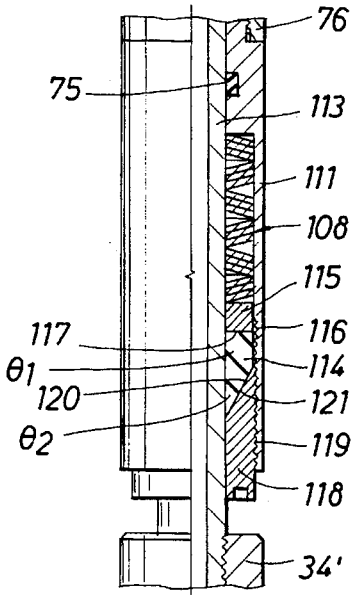
FIG. 8

INFLATION SHAPE CONTROL SYSTEM FOR INFLATABLE PACKERS

This is a Division of application Ser. No. 08/362,629 filed Dec. 22, 1994

FIELD OF THE INVENTION

This invention relates generally to an inflatable packer used, for example, in isolating a well formation to enable it to be treated with various chemical compounds or agents, and particularly to an inflatable packer having means to control its shape and deployment during inflation so that a more efficient pack-off is achieved. The invention has particular application to high expansion ratio inflatable packers.

BACKGROUND OF THE INVENTION

For an inflatable packer to form an effective seal against the surrounding walls of a well bore, the mid-portion thereof should lead the expansion during inflation and thus touch the walls first. On the other hand, if the end portions engage and seal first, well fluids can be trapped in an annular volume between such end portions and the packer will not properly seal off. Where the packer has long lengths of external armor such as overlapped slats or cable, there can be preferential expansion which traps fluid pockets as mentioned. Occasionally an elastomer cover over the center of the armor is employed, which can cause fluids to be trapped in annular pockets between each end on the packer and such central cover. Another problem encountered in inflatable packer setting is that the inner elastomer bladder which is arranged underneath the armor can inflate initially in such a way that a bubble is formed so that the bladder does not conform to the armor assembly. This can result in the formation of Z-folds, particularly where the energy to continue radial expansion of the bladder is greater than the energy to extend it axially over an uninflated portion of the bladder. A Z-fold causes non-uniform expansion of the bladder and ultimately can cause rupture.

Some efforts have been made to control the shape of an inflatable packer as it is inflated. For example U.S. Pat. Nos. 4,832,120 and 4,951,747 disclose systems where shear screws between the packer piston and the mandrel provide a degree of axial restraint. However these structures influence packer shape only during the very initial part of the first inflation, and further are inoperable for any additional packer settings. Thus a shear pin mechanism is not an effective way to control the shape of the packer element during inflation.

The present invention utilizes the concept that axial loads that are applied to the packer armor assembly, whether slats or cables, tend to increase the radial stiffness of such assembly. When sufficiently high axial loads are applied, the effect of the external central cover is minimized and the packer tends to have expansion at its mid-portion first during inflation. Moreover, the stiffness of armor assembly, whether it be overlapped slats or longitudinal cables, dominates bladder inflation behavious so that the inner bladder conforms to the armor during the entire inflation process to eliminate Z-folding of the bladder walls.

An object of the present invention is to provide a new and improved inflatable packer system including means to control the shape of the packer element during most of the inflation process in a manner that assures an effective packoff.

Another object of the present invention is to provide a new and improved inflatable packer system including means for applying axial loading to the packer element during inflation in a manner that controls the shape thereof during outward expansion into sealing engagement with a surrounding wall.

Another object of the present invention is to provide a new and improved inflatable packer system that includes a piston whose movement is restrained in a manner such that axial loads are applied which control inflation shape and prevent Z-folding of the inner bladder.

Another object of the present invention is to provide a new and improved inflatable packer system and method where a resilient means is employed to generate restraining forces which control the shape and deployment of the packer element during expansion.

Yet another object of the present invention is to provide a new and improved inflatable packer system where friction forces are generated to control the shape and deployment of the packer element during expansion thereof.

Another object of the present invention is to provide a new and improved inflatable packer system where continuously generated shear forces are employed to control the shape and deployment of the packer element during expansion thereof.

Another object of the present invention is to provide a new and improved inflatable packer system where swaging loads are employed to control the inflation shape of the packer.

Yet another object of the present invention is to provide a new and improved inflatable packer system where crushing of a sleeve member provides restraining forces that control the inflation shape of the packer element.

Still another object of the present invention is to provide a new and improved inflatable packer assembly that is constructed and arranged to obviate the various problems with prior devices noted above.

SUMMARY OF THE INVENTION

These and other objects are attained in accordance with the concepts of the present invention through the provision of an inflatable packer assembly including a central mandrel that carries upper and lower fittings which are connected to the respective ends of a packer unit. The packer unit comprises an inner elastomer bladder that is covered and protected by suitable expansible reinforcement or armor such as longitudinally extending, circumferentially overlapped metal slats, or longitudinal cables. An external elastomer sheath can surround the armor at about its mid-portion. In one embodiment a piston and cylinder structure is mounted preferably on the lower end of the mandrel and arranged such that inflation pressure applied to the interior of the bladder acts downward on the mandrel and upward on the piston to tend to cause the fittings to move relatively toward one another during inflation. However, in accordance with this invention, a substantially non-compressible oil which fills a chamber formed by the piston and the cylinder is pressurized by pressure forces on the piston, and seeks to flow through a vent passage to the outside. Such flow is restricted by valve means to cause the imposition of restraining axial loads on the end fittings which control the shape of the packer element and the deployment of the reinforcement as they are expanded. Other restraining means such as an assembly of disc springs also can be used. The axial loads control the stiffness of the reinforcement to provide maximum expansion at the mid-portion thereof to eliminate Z-folding of the bladder and the trapping of annular fluid volumes between the upper and lower ends of the packer element. In another embodiment, transversely biased friction pads are employed to generate the restraining forces, and in still another embodiments shear forces are created which continuously restrain longitudinal relative movement. Swaging or extrusion loads also can be employed to provide longitudinal restraint, as well as crushing loads on a yieldable sleeve member.

BRIEF DESCRIPTION OF THE DRAWINGS

The present invention has the above as well as other objects, features and advantages which will become more clearly apparent in connection with the following detailed description of preferred embodiments thereof, taken in conjunction with the appended drawings in which:

FIG. 7 is a view partly in elevation and partly in cross-section of an embodiment of this invention where friction loads are employed to control packer element shape;

FIG. 8 illustrates a modification of the system shown in FIG. 7;

FIG. 9 shows still another modification of the shape control system of FIG. 7;

FIG. 10 depicts yet another embodiment where continuous shear loads are utilized to control/packer inflation shape;

DETAILED DESCRIPTION OF PREFERRED EMBODIMENTS

Figure 1:
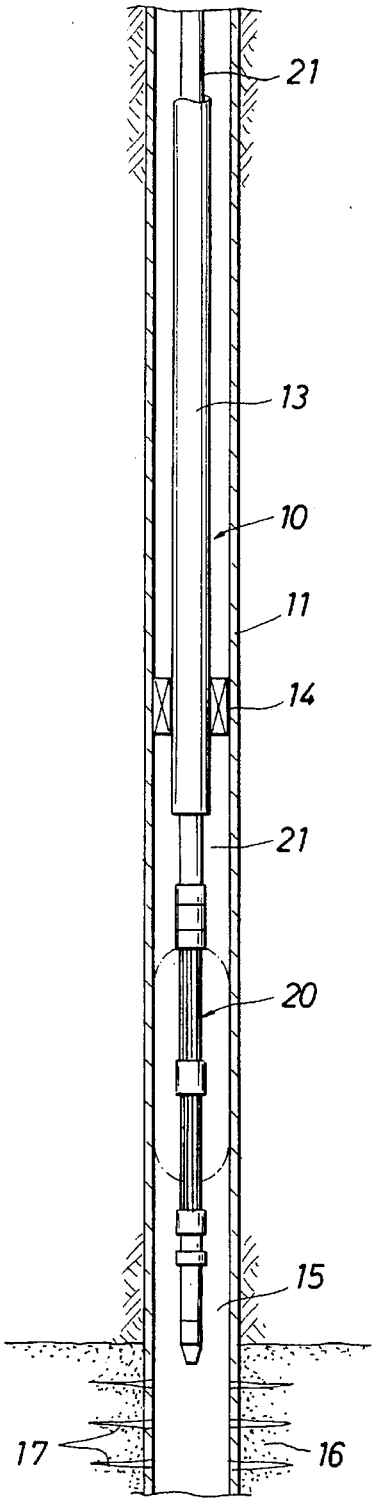
FIG. 1 is a schematic view of a well being treated using an inflatable packer.

Referring initially to FIG. 1, a well 10 is cased at 11 and can have a production string of tubing 13 disposed therein. A packer 14 adjacent the lower end of the tubing 13 isolates a well interval 15 which is communicated with a surrounding earth formation 16 by perforations 17. In order to treat the formation 16 with various chemicals in order to remedy some production problem that is being experienced, a string of tools including an inflatable packer apparatus 20 is lowered down through tubing 13 on a string of coiled tubing 21 that is injected at the surface by a suitable unit (not shown) having the usual storage reel, guide, injection assembly, and pump for circulating drilling fluids under pressure down through the coiled tubing. Appropriate connectors, back-flow preventor valves, pressure recorders, bypass valves, equalizing and bypass valves and the like can be included in the tool string as desired. The inflatable packer apparatus 20 is designed to have a high ratio between its expanded and retracted diameters for what may be designated as "through-tubing" service work in connection with the formation 16. This particular procedure has the advantage of not requiting the pulling and running of the production string 13 and the packer 14. A relatively high expansion ratio can be in the order of 3-to-1 so that an inflatable packer having a retracted o.d. of about 2⅛ inches can be expanded and seal off a casing having one i.d. about 6½ inches.

Figure 2A:
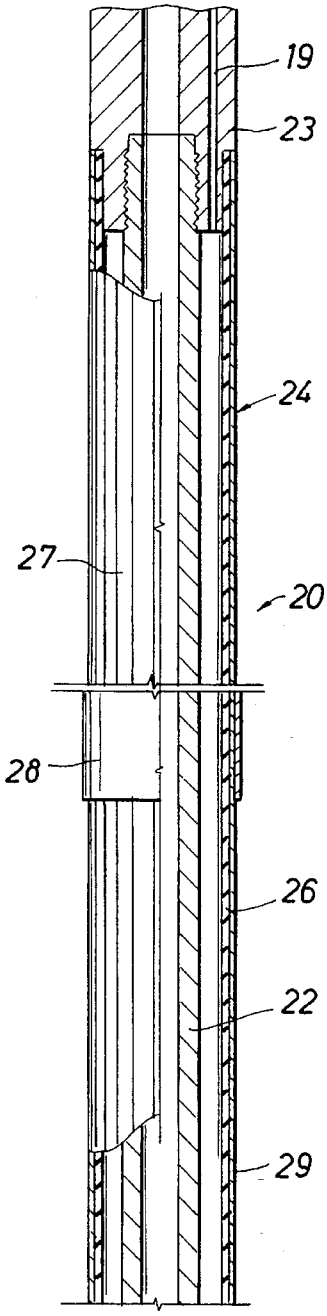
FIGS. 2A and 2B are longitudinal sectional views, with some parts in elevation, of an inflatable packer apparatus in accordance with this invention.
Figure 2B:
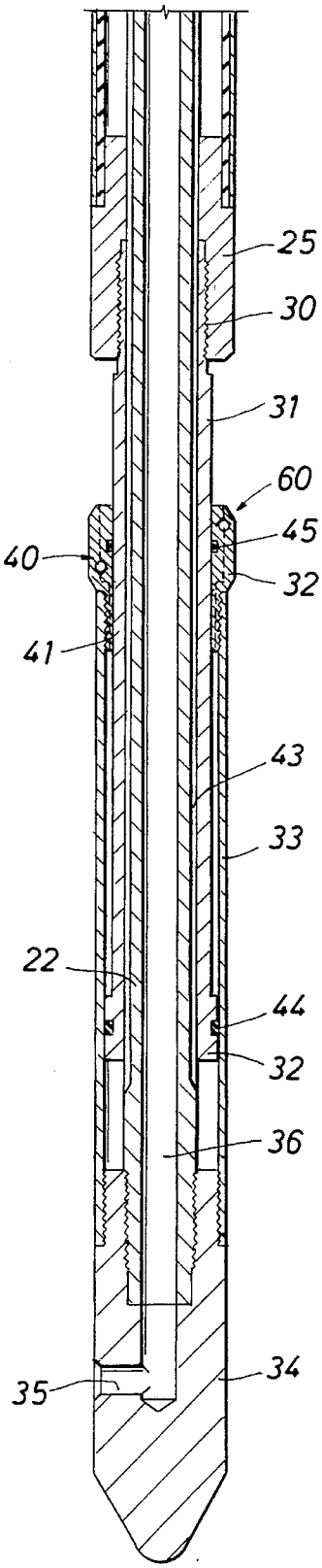

As shown in FIGS. 2A and 2B, the packer 20 includes a central mandrel 22 that carries an upper adapter 23 which is connected to the upper end of the inflatable packer element 24 and a lower adapter 25 that is connected to its lower end. The primary components of the packer element 24 are an inner elastomer sleeve or bladder 26, a covering layer of armor 29 which can be either longitudinally extending, partially overlapped metal slats 27 or stranded cables (not shown) layed side-by-side, and an elastomer sheath 28 that can typically cover a central portion of the armor 29. The ends of the slats 27 and the bladder 26 are firmly anchored inside the respective ends of the adapters 25 and 23, and the lower adapter 25 can move longitudinally along the mandrel 22 toward the upper adapter 23 during expansion of the packer element 24.

Figure 3:
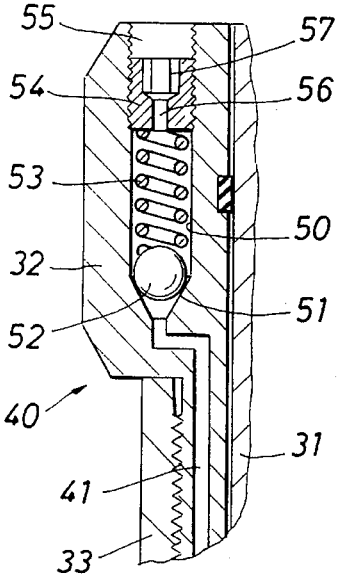
FIGS. 3 and 4 are fragmentary, enlarged sectional views of the valves employed in an inflation shape control system.

As shown in FIG. 2A, the upper adapter 23 has an inflation passage 19 so that pressurized fluid can be pumped down the coiled tubing 21 and into the interior of the bladder 26 to cause inflation and expansion thereof. The lower adapter 25 is threaded at 30 to a tubular member 31 having an enlarged diameter piston 32 on its lower end. The member 31 and piston 32 are arranged to telescope inside a tubular cylinder 33 whose upper end is threaded to a stop collar 29, and whose lower end is threaded to a bull nose 34. The nose 34 is mounted on the lower end of the mandrel 22 and has a radial port 35 that communicates with the central bore 36 of the mandrel. The annular chamber 37 between the member 31 and the cylinder 33 is filled with a non-compressible liquid such as oil that prevents upward movement of the sleeve member 31 and the piston 32 unless the oil is vented to the outside. Seal rings 44 and 45 prevent leakage. A selected level of back pressure can be maintained on such oil by a relief valve 40 which controls fluid flow through a vent passage 41 that leads from the chamber 37. As shown in FIG. 3, the relief valve 40 can include a longitudinal bore 50 formed in the stop collar 32 and having a conical seat 51 at its lower end. A ball valve element 52 is biased against the seat 57 by a compressed or preloaded coil spring 53. The upper end of the spring 53 engages an adjusting nut 54 having external threads that mesh with companion threads 55 in the upper portion of the bore 50. The nut 54 has a central port 56 that opens into a hexagonal socket 57 that is arranged to accept a suitable tool by which the spring pressure can be adjusted. The ball element 52 will remain against the seat 51 and close off the vent port 41 until the pressure in the chamber 37 predominates over the closing pressure of the spring 53, at which point the valve 40 will move upward and allow fluid to bleed from the chamber until the spring pressure predominates. Thus the valve 40 functions to maintain a minimum level of pressure in the chamber 37.

The annular space 42 below the piston 32 is communicated with the interior of the packer element 20 by one or more longitudinal grooves 43 formed in the outside surfaces of the mandrel 22. Thus the pressure of inflation fluids inside the packer element 20 acts upward on the piston 32 and downward on the bull nose 34 and thus downward on the mandrel 22. However upward movement of the piston 32, the sleeve member 31 and the lower adapter or fitting 25 is restrained by the fluid in the chamber 37, and the adapter 25 cannot move upward relatively toward the upper adapter 23 unless fluid in the chamber is vented as described above.

Figure 4:
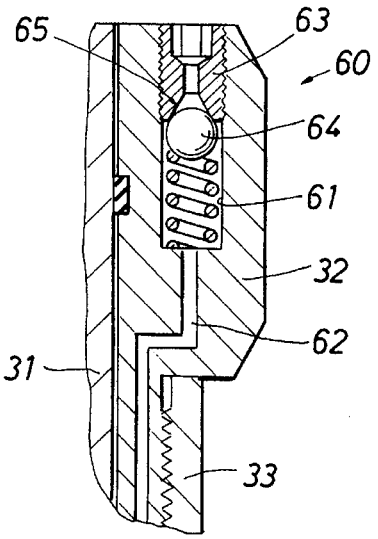

A check valve 60 which allows the chamber 37 to freely expand as the packer element 20 is deflated as shown in FIG. 4. Another longitudinal bore 61 in the stop collar 32 is communicated with the chamber 37 by a passageway 62, and has a ported seat 63 screwed into its upper end. A check ball 64 is biased with light force against the conical seat surface 65, and prevents any outward flow during packer inflation. However during deflation when the chamber 37 expands, fluids in the annulus flows freely past the ball 64 and into the chamber.

In use and operation of the embodiment shown in FIGS. 2–4, the inflatable packer 20 is assembled as shown in the drawings and, together with associated tool string components, is run into the production string 13 on the lower end of the coiled tubing 21. The chamber 37 is filled with oil through a suitable fill port (not shown) so that the piston 32 is in its lower position within the cylinder 33, and the relief valve 40 is set by compressing the spring 52 to provide a selected back-pressure in the chamber 37 as the packer unit 24 is inflated. Fluids standing in the well enter the bore 36 of the mandrel 22 and fill all empty spaces in the assembly, including those inside the bladder 26. The inflatable packer 20 eventually emerges from the lower end of the production string 13 and is lowered inside the casing 11 until it is adjacent but somewhat above the perforations 17. Then the tool string is halted and the coiled tubing 21 manipulated to close bypass valves and the like, after which the pump at the surface is started to inflate and expand the packer element 24 into sealing engagement with the surrounding walls of the casing 11.

Pressurized fluids pass into the inside of the elastomer bladder 26 via the passage 19 in the upper fitting 23 and apply pressure forces in all radial and longitudinal directions so that the bladder is expanded outward. At the same time the pressure of such fluid passes down through the grooves 43 and acts upward on the lower face of the piston 32 and downward on the upper end surface of the nose 34 that is located between the o.d. of the mandrel 26 and i.d. of the cylinder 32. Thus the lower adapter 25 tends to move upward along the mandrel 22 toward the upper adapter 23. However the oil in the annular chamber 37, owing to its incompressible nature, prevents such relative movement until the oil is pressurized enough to open the relief valve 40. When upward pressure forces on the ball element 52 predominate over the closing force of the spring 53, the valve opens and allows oil to bleed to the outside which enables upward movement of the adapter 25. The net result is that oppositely directed axial retraining forces are applied to the adapters 25 and 23 throughout the expansion of the packer element 24.

Such restraining forces control the inflation shape and deployment of the packer element 24 and prevent pockets or bubbles of well fluids from being trapped between the ends of the packer element, and also prevent Z-folding of the bladder 26 inside the outer armor 24. The forces accomplish these results by increasing the radial stiffness of the armor 24. Such restraining forces minimize the effect of the armor cover 29 so that the packer assembly as a whole undergoes maximum expansion at approximately its mid-portion during inflation. The increased armor stiffness causes it to dominate the behavior of the bladder 26 during inflation so that the bladder will conform to the armor cover 29 during the entire inflation process. The restraining forces should be applied to the adapters 25, 23 at least until the armor cover 29 has been expanded enough to engage the casing wall.

After the wellbore below the packer assembly 20 has been pressured to perform whatever service work was needed on the formation 16, the assembly is deflated by opening a deflate valve in response to manipulation of the coiled tubing 21. The packer 20 tends to retract on account of its resilient nature, and if desired a helical return spring can be used to assist in retraction. The tool string then can be retrieved to the surface with the coiled tubing 13. Although the present invention has been disclosed in connection with use in coiled tubing operations, of course the packer 20 could be run on other types of work strings, and set in open or cased boreholes, with or without production strings of pipe therein.

Figure 5:
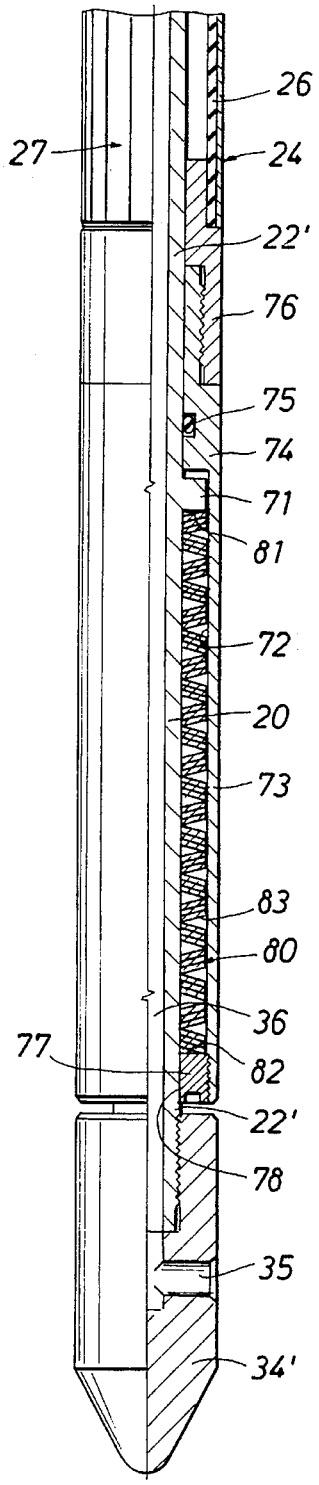
FIG. 5 is a view partly in cross-section and partly in elevation of another embodiment of a shape control restraining means.

Another embodiment of the present invention is illustrated in FIG. 5. Here a lower portion 70 of the mandrel 22' is provided with an outwardly directed annular shoulder 71 which extends into an internal annular recess 72 that is formed inside a tubular housing member 73. The upper end portion 74 of the housing 73 is inwardly thickened and sealed against the mandrel 22' by a seal ting 75, and the lower face 74' of the housing portion 74 is spaced upwardly from the top surface of the shoulder 71. The portion 74 is threaded to the lower end fitting 76 of the inflatable packer element 24, so that the end fitting and the housing member 73 can slide upward along the mandrel 22' as the packer element is inflated. The lower end of the housing member 73 is constituted by an externally threaded ring 77 having a central bore 78 through which the mandrel 22' passes. As in the previous embodiment, a nose plug 34' is connected by threads to the lower end of the mandrel 22', and has at least one radial port 35 that communicates with the bore 36 of the mandrel.

A relatively stiff resilient means, for example a stack of disc springs or Bellville washers indicated generally at 80, is positioned in the recess 72 and arranged to react between the lower face 81 of the mandrel shoulder 71 and the upper face 82 of the ring 77. Since the individual disc springs of the stack 80 must deflect or be temporarily flattened to some extent as the housing member 73 and the end fitting 76 move upward relatively along the mandrel 22' as the packer element 24 is inflated, the springs provide a restraint to such movement in order to control the inflation shape of the packer element 24. The individual disc springs 83 in the stack 80 are selected with respect to their height/thickness ratio to provide a desired restraining force vs. deflection curve. Preferably the stack 80 is arranged to have an overall relaxed length that is somewhat greater than the length of the recess 72 so that when assembled there is an initial deflection which provides a preload or minimum initial restraining force so that a certain inflation pressure inside the packer element 24 must be generated before any substantial upward movement of the lower end fitting 76 occurs. The preload can be obtained by turning the nut 77 so that its external threads, which mesh with internal threads in the lower end of the housing 73, advance the nut upward toward the shoulder 71. The axial space between the shoulder 71 and the lower face 74' allows such preload to be applied directly to the lower end fitting 76 so that it tends to retract the packer element 24. Although other mechanical or gas spring systems or resilient devices might be used, disc springs are preferred because they provide a high recovery force. Of course the individual discs 83 of the stack 80 can be stacked in various orientations and numbers, and with some discs having different rates than others to provide the desired overall restraining force.

As the inflation pressure inside the packer element 24 is relieved after a treating operation is completed, the packer element 24 will tend to retract toward its initial diameter. The stack of disc springs 80 also will lengthen as each disc 83 returns to its original or unstressed height, which provides a downward force on the end fitting 76 which also tends to retract the packer element 24. Hereagain the packer element 24 can be reinflated if further service work needs to be done at the same location in the well 10, or the tool string can be moved elsewhere and the packer element reinflated there. When no further reinflations are needed, the tool string is pulled upward through the production tubing 13 to the surface.

Figure 6:
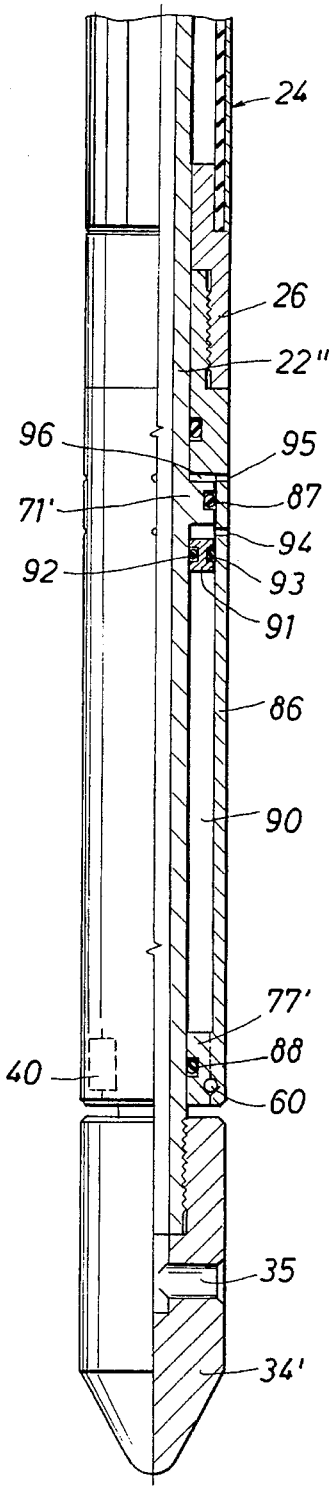
FIG. 6 is a view similar to FIG. 2B of still another embodiment of a hydraulic restraining means.

Still another embodiment of the present invention is illustrated in FIG. 6 where a housing member 86 and mandrel configuration 22" similar to that used in the FIG. 5 embodiment are employed. However in this embodiment the mandrel shoulder 71' carries a seal ring 87 which engages the inner wall of the housing 86, and the housing shoulder 77' is provided with a seal ring 88 that engages an outer surface of the mandrel 22" above the nose plug 34'. Thus arranged, an annular chamber 90 is formed which is closed at its upper end by a floating compensating piston 91 which carries inner and outer seal rings 92, 93. One or more radial ports 94 extend through the wall of the housing member 86 between the piston 91 and the shoulder 71' in order to communicate the upper face of the piston with the well annulus, and one or more additional ports 95 communicate the internal housing region 96 above the shoulder 71' with the well annulus. Valve systems 40 and 60 like those shown and described in connection with FIGS. 3 and 4 are arranged in the lower shoulder 77' of the housing member 86. The chamber 90 is filled with a suitable hydraulic oil that is substantially non-compressible.

As the tool string is lowered in a fluid-filled well bore where hydrostatic pressure increases with depth, such pressure is transmitted to the oil in the chamber 90 by the floating piston 91 which provides a movable upper wall thereof. The hydrostatic pressures also are communicated into the region 96 above the shoulder 71' to prevent the development of any unbalanced pressure forces due to such hydrostatic pressure. As the packer element 24 is inflated, upward movement of the lower end fitting 76 and the housing 86 is restrained by the hydraulic oil in the chamber 90 which is pressurized by upward forces on the lower shoulder 77'. At a certain set pressure the relief valve 40 will open and allow the oil to gradually vent to the outside. Thus upward movement of the end fitting 24 is restrained to control the inflation shape of the packer element 24. When the packer element 24 is deflated, well fluids can enter the check valve 60 and fill the chamber 90 as the lower fitting 76 and the housing 86 are slanted relatively downward along the mandrel 22". Hereagain a coil spring can be positioned in the chamber 90 to assist in retraction of the packer element 24.

Although in the embodiment shown the hydraulic oil initially filling the chamber 90 is vented to the outside via the relief valve assembly 40 as the packer element 24 is inflated, an auxiliary chamber (not shown) can be provided in the housing below the lower shoulder 77' and arranged to receive the vented oil, which then is resupplied to the chamber 90 via the check valve 60 as the packer element 24 is deflated. Such auxiliary chamber could have a spring-loaded floating piston defining its lower end, which would shift relatively downward as the oil is vented and then relatively upward as oil is returned to the chamber 90. This feature would prevent the possibility of any contaminated well bore fluids entering the chamber 90 as the packer element 24 is being deflated, and is particularly applicable to situations where the packer element is to be inflated and then deflated several times during a single trip into the well. As pressure is generated in the chamber 90 during inflation of the packer element 24, the compensating piston 91 moves up and abuts the lower face of the shoulder 71'. However the seal rings 92 and 93 remain below the ports 94 so that hydraulic fluid can exit the chamber 90 only via the relief valve 40.

Another embodiment of a system for applying a restraining force to the packer unit 24 in order to control the shape and deployment thereof during inflation is shown in FIG. 7. This as well as the embodiments shown in FIGS. 8–15 have particular application to permanently set bridge plug-type inflatable packers, but also can be used as retrievable/reinflatable devices. In this case a friction or brake load resists upward movement of the lower end fitting 76 of the packer unit 24 as the unit is axially foreshortened during inflation. The system includes a plurality of circumferentially spaced pad members 100 that are wedged between upper and lower rings 101, 102 having oppositely inclined surfaces 103, 104 that engage companion inclined surfaces on each of the pads 100. Instead of a plurality of individual pad members 100 a circumferentially continuous sleeve could be used. The pads 100 can be made of a suitable elastomer, plastic, composite, metallic or other suitable material where a friction force will be generated at the interface thereof with the outer surface of the mandrel 113. The upper ring 101 has a transverse upper surface 107, and a strong spring such as a stack of Bellville discs 108 reacts between the surface 107 and a downwardly facing surface 110 on the housing member 111. The lower ring 102 is adjustably threaded inside the lower end of the housing member 111 at 112, so that the ring can be turned to apply axial force to the stack of disc springs 108 and deflect the same by an initial, selected amount. Such deflection causes a selected normal force and inward pressure to be applied to the pads 100 so that they frictionally engage outer surfaces of the mandrel 113 with a predetermined holding or braking force. The angles $\theta_2$ and $\theta_2$ between the surfaces 103, 105 and the axis of the mandrel 113 can be varied in order to change the normal load and thus the friction holding force for a given output force of the disc springs 108. The friction holding force applied to the mandrel 113 as the packer unit 24 is expanded also adds to the axial load and increases the normal or radial load thereon.

By providing two different angles $\theta_1$ and $\theta_2$ the friction load that resists upward movement of the housing member 111 and the end fitting 76 along the mandrel 113 can be made to be different from the load that is applied when the housing member moves in the opposite direction. For example as shown in FIG. 8, the pads 114 and the upper ring 115 have engaged faces 116, 117 that extend at a fight angle to the longitudinal axis of the mandrel 113 so that the angle $\theta_1$ is 90°. The lower ring 118, which is adjustably threaded at 119 to the lower end portion of the housing member 111, has a downward and inwardly inclined surface 120 that engages a companion inclined surface 121 on each pad 114. This structure provides a large increase in friction forces on the mandrel 113 and thus an increased restraining force on the housing member 111 during inflation of the packer unit 24, and a greatly reduced friction force when the housing member 111 moves downward during deflation and retraction of the packer unit. Hereagain the nut 118 can be adjusted axially to preload the disc spring 108 to provide a selected braking force against upward movement of the housing 111.

FIG. 9 shows an embodiment of the present invention that is similar to those illustrated in FIGS. 7 and 8 except that the frictional restraining forces are generated by engagement with the inner wall of the housing member 111' rather than the outer surface of the mandrel 113'. Here the pads 150 each have upper surfaces 151 that incline upward and outward, and lower surfaces 152 that incline downward and outward. These surfaces are respectively engaged by companion surfaces on upward and lower expander rings 153, 154, the upper ring 153 being fixed to the mandrel 113' by threads 156 and the lower ring 154 being movable relatively along the mandrel. The lower ring 154 engages the upper end of a stack of disc springs 157 which are supported by a nut 158 that is adjustably connected to the mandrel 113' by threads 156.

The axial position of the nut 158 on the mandrel 113' controls the amount of compression of the disc springs 157 and thus the radial outward pressure that the pads 150 apply to the inner wall 160 of the housing member 111'. The resultant friction or braking force restrains upward movement of the housing member 111' and the lower fitting 76 of the packer unit 24. Such restraining force in turn controls the shape and deployment of the packer unit 24 as it is expanded by fluid under pressure.

FIG. 10 shows yet another embodiment of this invention where a continuous shear action is employed to create restraining forces that control the shape and deployment of the packer unit 24 during inflation thereof. Here the housing member 125 forms an internal annular cavity 126 which, like the embodiment shown in FIG. 8, contains a stack of disc springs 127, a drive ring 128, and a lower ring 130 that is adjustably threaded to the lower portion of the housing member 125 at 131. The pads 132, which are made of a material described above, each have a downward and inward inclined lower surface 133 that is engaged by the companion upper surface 134 of the ring 130, and the upper surfaces 135 of the pads abut the lower surface 136 of the drive ring 128 at a fight angle to the axis of the mandrel 137. A substantial length of the mandrel 137 inside the housing 125 is provided with a rough external surface, for example by small threads 140, knurling or other similar surface treatment that provides a high rugosity. The radial inward forces on the pads 132 due to the output force of the disc springs 127 causes the surface roughness 140 to bite into or embed in the inner surfaces of the pads 132, so that as they move upward during expansion of the packer unit 24, thin layers of the material are sheared off to produce restraining forces on the housing 125 and the lower end fitting 76. As contrasted with the principles involved in previous embodiments, the axial restraining load in this case is related to the shear strength of the materials from which the pads 132 are made, rather than being a function of the coefficient of friction between relatively moving members. As in previous embodiments, the pads 132 can have oppositely inclined end surfaces which incline at the same or different angles, and more than one set of pads and companion rings can be employed. The inclined surfaces 133, 134 are active primarily during packer unit inflation, and there is much less resistance to downward movement of the housing 125 during deflation because the adjusting ting 130 is attempting to move away from the pads 132.

Figure 11:
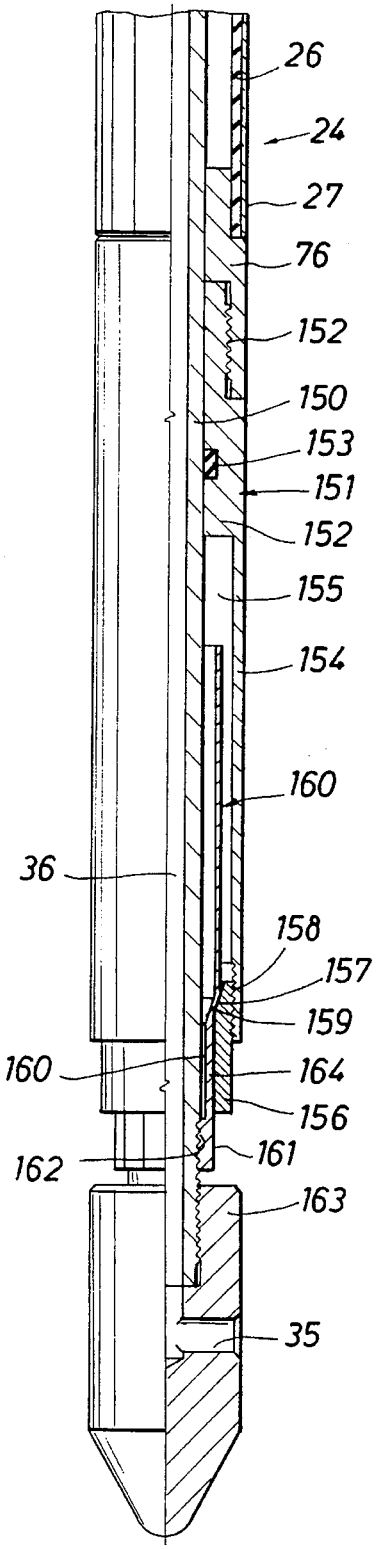
FIGS. 11 and 12 are quarter sectional views of embodiments where swage loads are employed to control packer inflation shape.

An embodiment of the present invention where the restraining forces are generated in response to drawing or pulling a swage along a cylindrical metal member is illustrated in FIG. 11. Here the mandrel 150 carries a housing 151 that is threaded at 152 to the lower end fitting 76. An inwardly thickened portion 152 of the housing 151 is sealed with respect to the mandrel 150 by a seal ring 153, and a tubular portion 154 thereof is spaced outwardly of the mandrel to define an annular chamber 155. An annular die 156 having an upwardly and outwardly inclined or tapered inner surface 157 is threaded at 158 to the lower end of the housing portion 154. A relatively thin metal sleeve 160 has an enlarged lower end section 161 that is threaded at 162 to the lower end of the mandrel 150 where it also threads into the nose plug 163. The lower portion 164 of the sleeve 160 has an outer diameter that is slightly less than the diameter of the bore 160 of the die 156, and after being widened at region 157 has an elongated upper portion with an outer diameter that is somewhat larger than the diameter of the bore 160.

As in previous embodiments, the upper fitting 76 and the housing 151 move upward along the mandrel 150 as the packer element 24 is inflated, and the bore 36 of the mandrel 150 is communicated to the well bore outside via a lateral port 35 so that treatment chemicals or agents can be pumped down through the mandrel under pressure and into the well bore therebelow. The packer element 24 includes an elastomer bladder 26 that is protected by external reinforcement 27 that is to be restrained during expansion in order to control the shape and deployment of the packer element.

In operation, inflation of the packer element 24 tends to pull the lower end fitting 76 and the housing 151 upward along the mandrel 150. Such upward movement is restrained by forces due to engagement of the die 156 with outer surfaces of the sleeve 160. When the level of such forces is sufficient, the sleeve 160 begins to extrude relatively downward through the die to allow upward movement of the housing 151 and the end fitting 76. The restraining forces that are applied to the housing 151 as the die 156 is pulled upward along the metal sleeve 160 and swages the sleeve inward to a smaller diameter are applied to the end fitting 76 to increase the lateral stiffness of the reinforcement 27.

The shape and inclination angle of the swaging surface 157 can be changed to influence the load required to deform the sleeve 160 and thus control the restraining forces. The die 156 can be turned within the threads 158 during initial assembly to tighten it against the region 157 and thereby preload the system prior to use. A number of different metals and alloy combinations can be used for the sleeve 160 to achieve desired extrusion loads.

Figure 12:
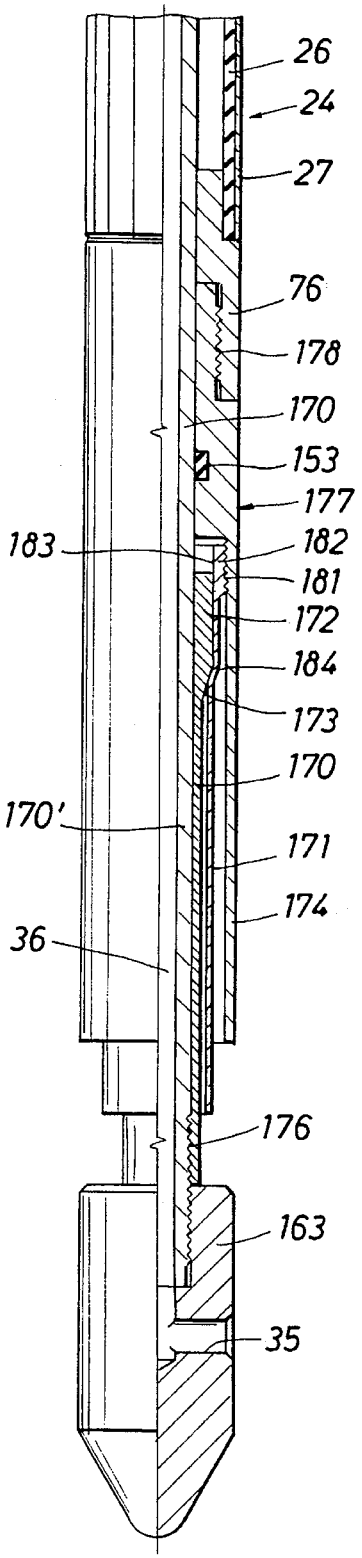

FIG. 12 shows an embodiment of the present invention that is similar to that shown in FIG. 11, except that a swage mandrel 170 is pulled relatively downward through a thin metal sleeve 171 as the packer element 24 is inflated. The swage mandrel 170 has an enlarged head 172 with a downward and inwardly inclined lower surface 173. The reduced diameter lower portion 174 of the mandrel 170 is threaded to the packer mandrel 170 at 176. The housing 177 which is connected to the lower end fitting 76 at 178 has a depending skirt 180 with internal threads 181 to which the upper end portion 182 of the sleeve 171 is attached. The sleeve 171 has an upper inner bore 183 that is slightly larger in size than the outer diameter of the head 172 and then is narrowed in diameter at a transition region 184. The lower portion of the sleeve 171 has a lesser inner diameter than the outer diameter of the head 172, so that as the housing 177 and the end fitting 76 are pulled upward along the mandrel 170 during inflation of the packer element 24, the sleeve 171 is forced upward over the swaging head 172 which expands the sleeve to a larger diameter. Such swaging action produces restraining forces which oppose upward movement of the end fitting 76 and thereby control the inflation shape of the packer element 24 as it expands. Hereagain the sleeve 171 can be torqued upward within the threads 181 during assembly to preload the system prior to use.

A principle advantage to the embodiments shown in FIGS. 11 and 12 is that the material properties of the metal sleeves 160 and 171, which greatly influence the extrusion forces, are known so that the restraining forces are quite predictable. The packer element 24 can be deflated without any appreciable opposing forces because the sleeves 160 or 171 will have been permanently deformed. Thus the housings 151 and 177 can move readily downward as the packer element 24 retracts toward its original diameter.

Figure 13:
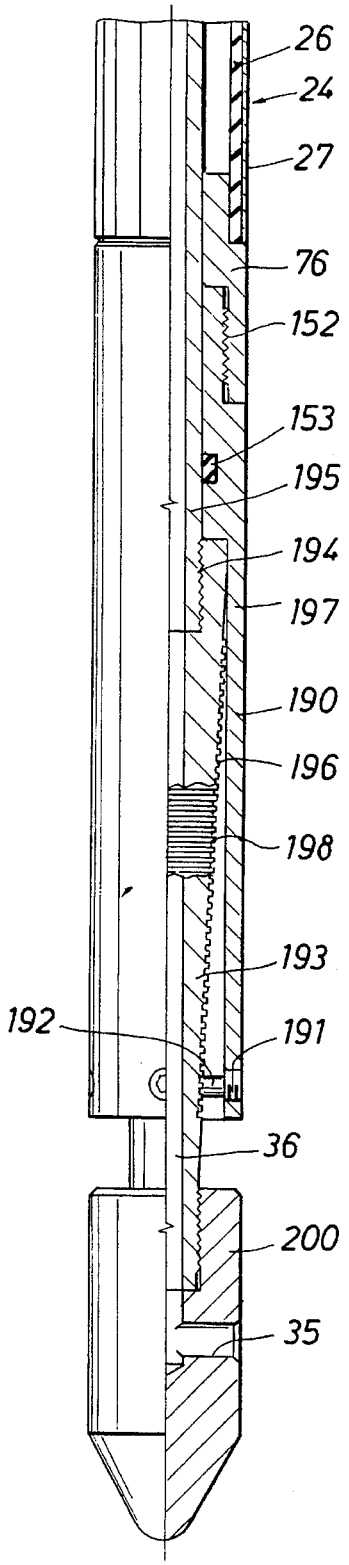
FIG. 13 is a right-side sectional view of another embodiment of the present invention where material shear is used to control packer element inflation shape.

Another embodiment that is similar in concept to the embodiment shown in FIG. 10 is illustrated in FIG. 13. Here the housing 190 has a plurality of radial threaded holes 191 near its lower end which receive threaded pins 192 that project inwardly as shown. A mandrel 193 that is attached by threads 194 to the lower end of the packer mandrel 195 has a conical outer surface 196 that inclines downward and inwardly at a shallow angle, with the larger diameter surface being adjacent the upper end portion 197 of the housing 190. The surface 196 has a rough texture formed, for example, by shallow buttress-type threads 198. The pins 192 are made of a material such as aluminum or aluminum alloy which is sheared off in thin layers as the housing 190 is pulled upward relative to the mandrel 193 by the end fitting 76 during expansion of the packer element 24.

The shape and inclination angle of the mandrel surface 196 influences the load required to shear material off the inner ends of the pins 192, and can be used to control the magnitude of the restraining load on the lower end fitting 76. The properties of the material from which the pins 192 is made greatly influences the shear forces required and provides a predictable restraining force.

As in previous embodiments, the lower end of the mandrel 193 is threaded to a bottom nose 200 having one or more side ports 35 through which treating fluids are pumped under pressure. The inflatable packer element 24 includes an inner elastomer bladder 26 that is covered by outer reinforcement 27, for example overlapped slats. The housing 190 and the end fitting 76 can move freely downward during deflation of the packer element 24 due to the conical or inclined shape of the mandrel 193.

Figure 14:
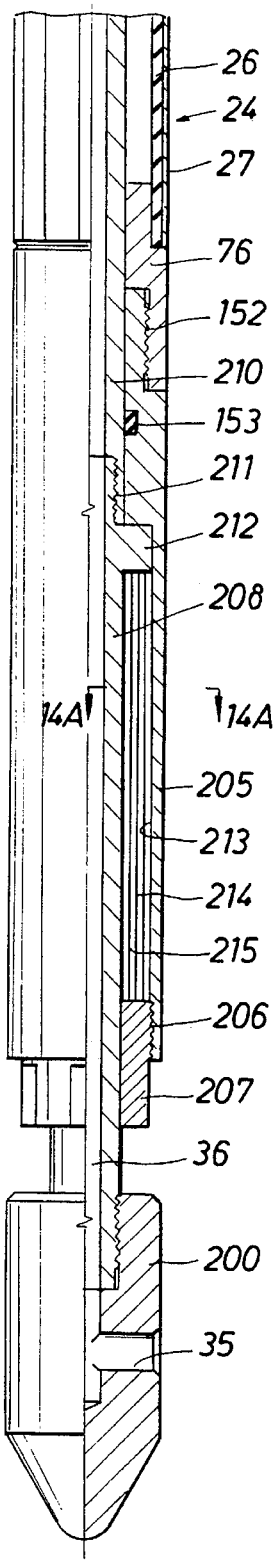
FIG. 14 is a view similar to FIG. 13 where a crushable sleeve member provides restraining loads.
Figure 14A:
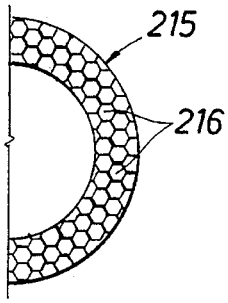
FIG. 14A is a half cross-section of the sleeve member of FIG. 14.

FIG. 14 discloses yet another embodiment of a restraining system for use in controlling the inflation shape of the packer element 24 as it is expanded by fluid under pressure. The tubular housing 205 which is suspended from the lower end fitting 76 has threads 206 at its lower end which engage companion threads on an adjustable drive nut 207. A mandrel 208 which is threaded to the lower end of the packer mandrel 210 at 211 has an outwardly directed annular shoulder 212 whose outer surface slides adjacent the inner wall surface 213 of the housing 205. An internal annular cavity 214 is formed between the shoulder 212 and the nut 207, and has positioned therein a sleeve 215 that is progressively crushed in response to axially applied loads. As shown in FIG. 14A, for example, the sleeve 215 can be formed of a corrugated aluminum or honeycomb material that is similar in arrangement to-that used in cardboard storage boxes. The sleeve 215 is formed with a large number of vertical, thin walled hexagon tubes 216 that are parallel and have common walls on all sides with adjacent tubes.

After assembly, the nut 207 is tightened by a suitable tool to initiate buckling or crushing failure of the sleeve 215. Then as the packer element 24 is inflated downhole so that the nut 207 is forced relatively upward toward the shoulder 212, a progressive buckling failure occurs along the length of the sleeve 215. The transverse cross-sectional area of the sleeve 215 and its material properties provide the predominant influence on the load required to collapse same and produce a restraining force on the end fitting 76 that controls the inflation shape of the packer element 24. Since the properties of the sleeve material greatly influence the collapse force required, a highly predictable restraining force is produced.

Figure 15:
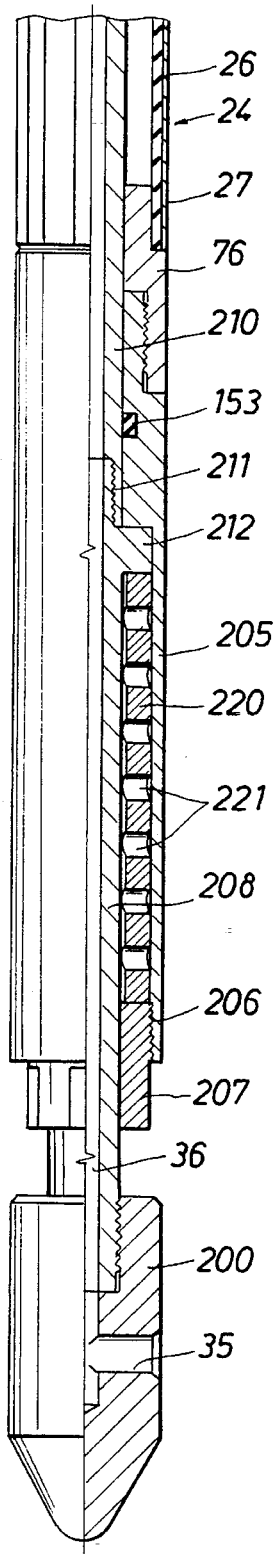
FIG. 15 is a right-side sectional view similar to FIG. 14 where another type of crushable sleeve member provides restraining forces during inflation of the packer element.
Figure 15A:
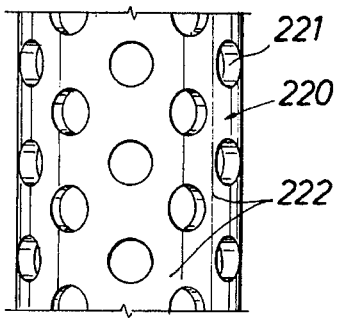
FIG. 15A is an elevational view of a portion of the sleeve member of FIG. 15.

FIG. 15 shows another embodiment of the present invention where a cylindrical member or sleeve 220 is used to produce a restraining force. The various parts employed here which are like those used in the embodiment of FIG. 14 are given the same reference numerals. The sleeve 220 which is mounted between the shoulder 212 and the nut 207 is weakened by drilling a large number of radial holes 221 through the wall thereof as shown in FIG. 15A. As the packer element 24 is inflated, the sleeve 220 is compressed between the nut 207 and the shoulder 212. When such compression loading reaches a predetermined level the beam portions 222 between the holes 221 begin to yield so that the sleeve 220 is foreshortened. The sleeve 220 continues to collapse as the packer element 24 is inflated and the resultant restraining force on the lower end fitting 76 controls the inflation shape of the packer element. The size and relative placement of the holes 221, and the material used for the sleeve 220 and its wall thickness, controls the loading required to collapse the sleeve. The sleeve 220 can be made of various metals or alloys which provide the desired results. The collapse load requirement in turn controls the restraining force on the lower end fitting 76, and thus the inflation shape of the packer element 24.

Hereagain the bottom end of the mandrel 202 has its lower end threaded to a bottom nose 200 having one or more radial ports 35 that allow treating or other fluids under pressure to be pumped into the wellbore 15 below the packer element 24. The ports 35 communicate with the bore 36 of the mandrel 208 which extend upward through the packer element 24 to one or more valve systems that can be activated by manipulation of the coiled tubing string 21.

It now will be recognized that a new and improved inflatable packer system has been disclosed which includes various restraining means to control the inflation shape and deployment of the packer element. The invention has particular application to inflatable packers having a high expansion ratio, that is, a high ratio between inflated and deflated diameters. Since certain changes or modifications may be made in tile disclosed embodiments without departing from the inventive concepts involved, it is the aim of the appended claims to cover all such changes and modifications falling within tile true spirit and scope of the present invention.

What is claimed is:

1. An inflatable packer assembly, comprising: a mandrel; normally retracted inflatable packer means on said mandrel adapted to be expanded by pressurized fluid into sealing engagement with a surrounding well conduit wall, said packer means having opposite ends; first head means on said mandrel connected to one of said packer ends and second head means on said mandrel connected to the other of said packer ends, said head means being movable relatively toward one another during expansion of said packer means; hydraulically operable means for restraining said relative movement to control the inflation shape of said packer means; said hydraulically operable means including piston means coupled to one of said head means and cylinder means coupled to the other of said head means, said piston and cylinder means defining a fluid-filled chamber that is pressurized in response to said relative movement; and pressure relief venting means for venting pressurized fluid from said chamber after the pressure therein has reached a predetermined value.

2. The packer assembly of claim 1 wherein said pressure relief venting means includes a pressure relief valve having a selected setting.

3. The packer assembly of claim 2 further including check valve means for equalizing the pressure in said chamber with pressure in the well annulus during deflation of said packer means.

4. An inflatable packer comprising: a mandrel; an annular inflatable packer element on said mandrel and adapted to be inflated and expanded from a normally retracted condition to an expanded condition against a surrounding well conduit wall, said packer element having upper and lower ends and a central portion; an upper head on said mandrel anchored to said upper end and a lower head on said mandrel anchored to said low end, said lower head being movable upward along said mandrel during expansion of said packer element; and means for restraining upward movement of said lower head including telescoping members defining a liquid filled chamber, one of said members being connected to said lower head, and control means for venting liquid from said chamber to allow telescoping movement when the pressure in said chamber exceeds a predetermined level.

5. The packer of claim 4 wherein said control means includes a pressure relief valve having a selected setting.

6. The packer of claim 4 further including check valve means for allowing expansion of said chamber during deflation and retraction of said packer element.

7. The packer of claim 4 wherein said packer element includes an inner elastomer bladder, expansible armor means surrounding said bladder, and an elastomer sleeve on said central portion.

8. The packer of claim 6 further including an annular floating piston having one side defining a movable wall of said chamber; and means for subjecting the other side of said piston to the hydrostatic pressure of fluids externally of said one member.

9. The packer of claim 8 further including piston means on the other of said members sealed with respect to said one member, one side of said piston means being adjacent said floating piston and subject to said hydrostatic pressure, and additional means for subjecting the other side of said piston means to the hydrostatic pressure of fluids externally of said one member.

10. A method of controlling the shape of an inflatable packer element as it is inflated and expanded in a borehole, said packer element having an inner elastomer bladder covered by an outer sheath of expansible armor, comprising the steps of: applying pressure to said bladder to inflate it; and applying restraining forces to the ends of said armor to increase the stiffness thereof so that said bladder maintains substantially the same shape as said armor during expansion; said restraining forces being generated by forming a fluid-filled variable volume chamber having a movable wall connected to one of said ends, and preventing movement of said wall unless the pressure in said chamber exceeds a predetermined value.

* * * * *